United States Patent [19]

Beaumont

[11] Patent Number: 4,632,639

[45] Date of Patent: Dec. 30, 1986

[54] AIR COMPRESSOR WITH PRE-LOADED SPRING CLUTCH

[75] Inventor: Paul Beaumont, Gwent, Scotland

[73] Assignee: Lucas Industries Limited, Birmingham, England

[21] Appl. No.: 715,465

[22] Filed: Mar. 25, 1985

[30] Foreign Application Priority Data

Mar. 30, 1984 [GB] United Kingdom ..... 8408227
Jul. 26, 1984 [GB] United Kingdom ..... 8419062

[51] Int. Cl.[4] ..... F04B 49/08

[52] U.S. Cl. ..... 417/223; 192/91 A; 192/85 AA

[58] Field of Search ..... 417/223; 192/91 A, 85 AA

[56] References Cited

U.S. PATENT DOCUMENTS 2,502,798 4/1950 Nabstedt et al. ..... 192/91 A
2,543,252 2/1951 Nabstedt et al. ..... 192/91 A
3,747,729 7/1973 Storer ..... 192/85 AA

FOREIGN PATENT DOCUMENTS 2125114 2/1984 United Kingdom .

*Primary Examiner*—Richard E. Gluck
*Attorney, Agent, or Firm*—Holman, & Stern

[57] ABSTRACT

An air compressor having a piston driven from an input shaft via a multi-plate clutch which is normally held in engaged condition by a spring device which is pre-loaded by one or more screw members arranged to apply a compressive force across the spring device and also to maintain the clutch in assembled condition.

6 Claims, 1 Drawing Figure

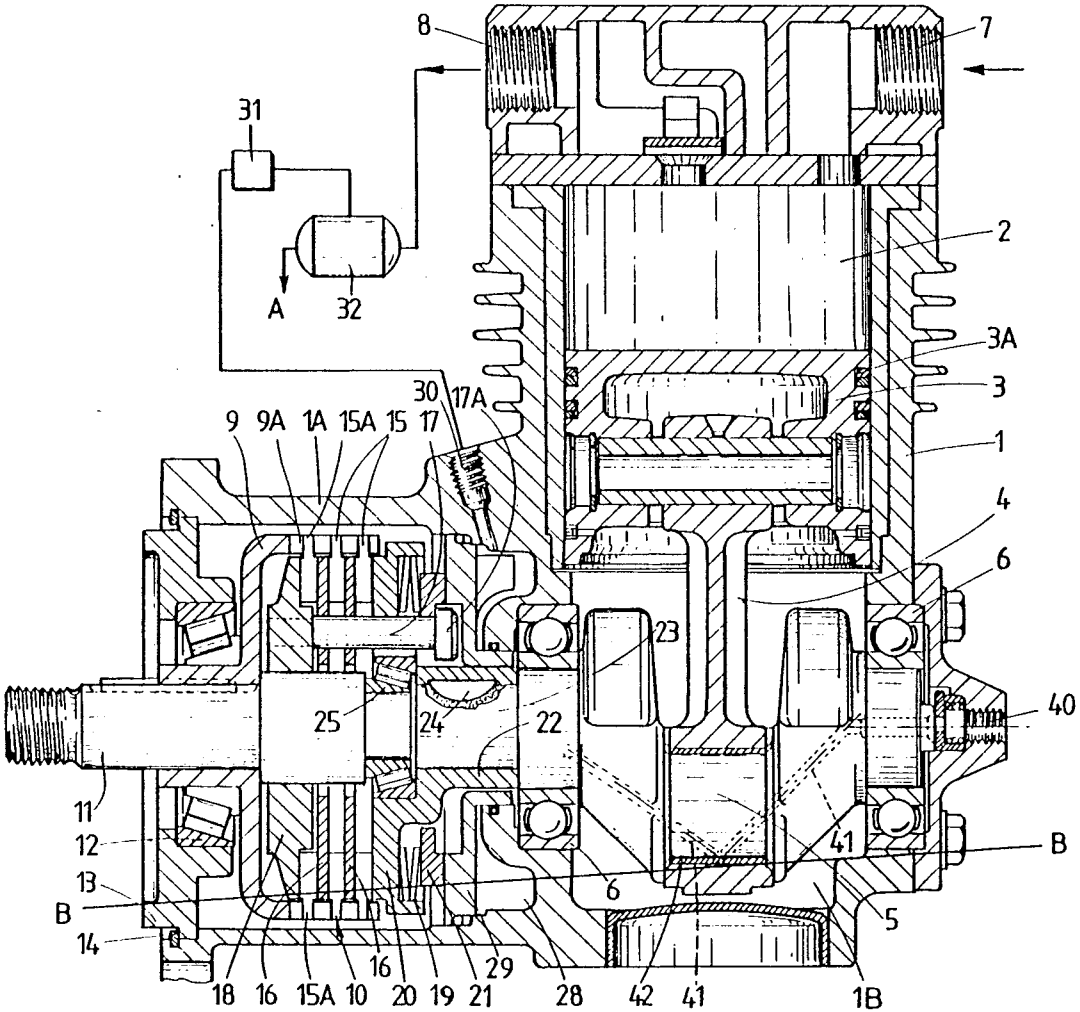
7
2
3A
3
1
4
6
40
B
5
1B
41
42
28
29
21
19
20
16
10
15A
16
18
14
13
B
12
11
25
24
22
23
6
41
17A
30
17
15
15A
1A
9A
9
8
32
A
31

AIR COMPRESSOR WITH PRE-LOADED SPRING CLUTCH

This invention relates to an air compressor primarily for use in a vehicle air-actuated braking system, and being of the kind having at least one compressor element operable by drive means to effect compression of air within a space, the compressed air usually being fed, in use, to a reservoir and thence on demand to the braking system for actuation of the latter.

In FIG. 1 of our published British Patent Specification No. 2,125,114A there is described a compressor of the aforesaid general kind and including a clutch device for transmitting drive from the drive means to the compressor element when compression is required. The clutch is normally held in engagement by a spring device and is disengagable by a device responsive to a pressure resulting from the compressor output to interrupt the drive to the compressor element when said pressure reaches a predetermined value. With such an arrangement, it is desirable for the spring device to be set to a predetermined pre-load in order that the clutch may operate satisfactorily over a range of operating conditions. Because of manufacturing tolerances in the other clutch components, it is often difficult, in practice, to achieve the desired pre-load in the spring device with the required degree of accuracy. Such expedients as shims have been proposed to take up excess tolerances, but these are time consuming to assemble and not, therefore, cost effective.

An object of the invention is to provide an air compressor of the aforesaid general kind in which the aforesaid problem is alleviated.

According to the invention, an air compressor comprises at least one compressor element operable by drive means to effect compression of air within a space, a clutch for transmitting drive from the drive means to the compressor element when compression is required, and a spring device operable normally to urge the clutch into engagement, the spring device being preloaded by one or more screw members arranged to apply a compressive force across the spring device and also acting to maintain the clutch in assembled condition.

In one convenient arrangement, the clutch is of the multi-plate type having interleaved driving and driven plates of which the driving plates are rotatable with a drive input shaft, each screw member passing axially through the clutch plates and being threadedly engaged at one end in a non-driven clutch member, the other end of each screw member engaging thrust means acting on the spring device, the spring device acting between said thrust means and another clutch member disposed at the side of the clutch plates remote from the non-driven clutch member.

The invention will now be described, by way of example, with reference to the single accompanying drawing which is a longitudinal cross-section of one embodiment of the air compressor of the invention.

Referring to the drawing, the compressor illustrated therein is primarily intended for use with a vehicle air-actuated braking system, of which a part is illustrated diagramatically. The compressor comprises a housing 1 defining a cylinder 2 within which slides a piston 3, coupled by a connecting rod 4 to a crankshaft 5 supported in bearings 6 mounted in the housing. As indicated by the arrows, air enters the cylinder during the induction stroke of the piston via an inlet port 7 and leaves the cylinder via an exhaust port 8, air flow through the ports being controlled by reed or other suitable valves, in conventional manner. The housing 1 has a generally cylindrical portion 1A forming a clutch housing.

A first hollow clutch member 9 forms part of a clutch, indicated generally at 10, by which drive is transmitted to the crankshaft 5 from a drive input shaft 11 rotatably supported in a taper roller bearing 12 mounted in an end cap 13 of the housing 1, the cap being retained in the housing by a circlip 14. The clutch member 9 is keyed at 9A to the drive input shaft for rotation therewith.

The clutch 10 is illustrated as a multi-plate clutch, which may be dry or oil immersed, and which includes a plurality of driving clutch plates 15, contained within the hollow clutch member 9 and keyed to axial slots 9A in the clutch member 9 by projections 15A. Driven plates 16 of the clutch interleaved with the plates 15 are non-rotatably mounted on but axially slidable along clamping bolts 17 threadedly engaged in a clutch member 18 rotatably mounted relative to the drive input shaft 11. A conical spring washer assembly 19 is constrained between a second clutch member 20, and a thrust member 21. The member 20 is supported on the shaft 11 by way of a further taper bearing 25 and has an axially extending boss 22 by which it is keyed at 24 to an extension 23 of the crankshaft.

The clamping bolts 17 pass through both the clutch member 20 and thrust member 21 with heads 17A of the bolts abutting the thrust member to react the force of the spring washer assembly.

The housing 1 forms chamber 28 containing an annular piston 29 slidable therein, the piston acting via the thrust member 21 on the conical washer assembly 19. An air inlet port 30 to the chamber 28 is connected by way of a governor valve 31 to a reservoir 32 connected to the outlet port 8 of the compressor. The reservoir would normally be connected via a line A to one or more brake actuators (not shown) of a vehicle braking system, in conventional manner.

In order to achieve correct operation of the clutch, it is desirable to pre-load the conical washer assembly 19 as accurately as possible and one of the major advantages of the present invention is that it enables this to be done more accurately than hitherto and in a simple and convenient manner, after assembly of the clutch components by adjustment of the bolts 17 to vary the load applied to the washer assembly via the thrust member 21.

The drive input shaft 11 is continuously rotated, in use, by a power source such as the engine of a vehicle in which the compressor is installed. The chamber 28 is initially unpressurised and the conical washer assembly 19 clamps the clutch plates into firm engagement, enabling drive to be transmitted from the drive input shaft 11 via the clutch 10 to the crankshaft extension 23, causing reciprocation of the piston 3 and charging of the reservoir 32. When the pressure within the reservoir reaches a predetermined value, the governor valve 31, which is responsive to the reservoir pressure, operates to apply the reservoir pressure to the chamber 28. The area of the piston 29 is chosen, in relation to the applied air pressure and force of the washer assembly 19, so that the reservoir pressure applied to the piston produces sufficient force to overcome the washer assembly 19 and thereby pushes the clutch member 20 to the left to disengage the clutch. This interrupts the drive between the drive input shaft 11 and the compressor piston and prevents further charging of the reservoir until this is required according to the conditions of use.

As usage of the braking system takes place, the pressure in the reservoir will be prgressively reduced and will ultimately reach a predetermined pressure at which the governor valve is set to operate to disconnect the reservoir from the chamber 28. This allows the pressure in this chamber to decay so that the clutch disengagement force exerted by the piston 29 is reduced, enabling the conical washer assembly 19 to re-exert a clutch engagement force.

In further explanation of the clutch device, when chamber 28 is initially unpressurized, the washers 19 act between the clutch member 20 and, via thrust member 21 and screw 17, on clutch member 18. The washers thereby urge the clutch member 20 to the left and clutch member 18 to the right so as to clamp the clutch plates and maintain them in engagement. The clutch is disengaged by the piston 29 moving to the left under sufficient force to compress the washers 19, thereby enabling the thrust member 21 to move to the left away from the heads 17A and thus relieve the clamping force applied by the clutch members to the clutch plates.

During normal operation of a vehicle in which the system is installed, the cycle will be repeated to maintain the pressure in the reservoir 32 within a range between desired maximum and minimum pressures.

Axial thrust forces are transmitted by the bolts 17 and no axial forces are transmitted by the clutch member 9, which is accordingly only required to transmit torque. This clutch member may therefore be of relatively light weight construction. Lubrication of the clutch is effected from an oil inlet 40 via drillings 41 in the crankshaft 5, such drillings also providing lubrication for the big-end bearing 42 of the compressor. Inevitably, leakage takes place from the bearing 42 into the crankcase 1B and, in the event that this becomes excessive, a problem can arise due to splashing of the oil by the big-end bearing onto the piston 3 and leakage of oil past the piston rings 3A into the cylinder. This is undesirable since oil contamination of the compressed air can result.

In order to minimise this problem, passages (not shown) are provided in the compressor housing 1 and the extension 1A thereof to enable oil deposited in the crankcase 1B to be transferred, during operation of the compressor into a clutch chamber defined by the housing 1A.

The transfer passages extend longitudinally through the housing 1 and then upwardly into the clutch housing.

When the compressor has been at rest for some time, oil may accumulate in the crankcase 1B, but this is only allowed to reach a predetermined level which is indicated in the illustrated embodiment by the line B—B. For reasons explained below, this line is shown at 4° relative to the input shaft 11, and is at the level of the upper extremity of the transfer passages. Any further oil entering the crankcase 1B will simply cause oil to flow over the weir, maintaining the oil level in the crankcase as shown. When the compressor piston starts to rotate, splashing may occur initially for a few revolutions, but pressure build-up in the crankcase will rapidly expel accumulated oil through the transfer passages into the clutch chamber. The crankcase will then remain substantially free of excess oil until the piston becomes stationary once more.

It is sometimes necessary for the compressor to be installed in an attitude such that the rotational axis thereof is tilted by up to about 4° with the drive input shaft 11 then being slightly higher than the crankshaft 5. In order to ensure that oil does not accumulate in the crankcase 1B to an excessive level when such a tilted installation is carried out, the transfer passages are arranged to set a maximum desired oil level for the 4° tilt position; in the event that the compressor is installed with the rotational axis horizontal, the oil level in the crankcase in the stationary condition will automatically be lower and within the desired limits.

It will be understood that the passages may take any convenient form and may be provided internally within the walls of the housing 1 and extension 1A or externally thereof by the provision of one or more pipes. The clutch may, of course, be of any convenient oil-immersed type and the details of the compressor itself may be varied according to requirements.

I claim:

1. An air compressor comprising at least one comprssor element operable by drive means to effect compression of air within a space, a clutch for transmitting drive from the drive means to the compressor element when compression is required, and a spring device operable normally to urge the clutch into engagement, the spring device being pre-loaded by at least one screw member arranged to apply a compressive force across the spring device and also to maintain the clutch in assembled condition wherein the clutch is of the multi-plate type having interleaved driving and driven plates of which the driving plates are rotatable with a drive input shaft, the screw member passing axially through the driven clutch plates and being threadedly engaged at one end in a non-driven clutch member, the other end of the screw member engaging thrust means acting on the spring device, the spring device acting between said thrust means and another clutch member disposed at the side of the clutch plates remote from the non-driven clutch member.

2. An air compressor according to claim 1 wherein the spring device is a conical washer assembly.

3. An air compressor according to claim 2 wherein said non-driven clutch member is carried by the drive input shaft which is freely rotatable relative to said non-driven clutch member.

4. An air compressor according to claim 1 wherein a piston subject to a pressure resulting from the compressor output is arranged to overcome the force of said spring means to disengage the clutch when said pressure reaches a predetermined value.

5. An air compressor according to claim 5 wherein said piston acts on said thrust means.

6. An air compressor according to claim 1 wherein driving force is transmitted to the driven clutch plates by a hollow clutch member containing the clutch plates, said member being keyed to said drive input shaft and, at its outer periphery, to the driven clutch plates.

* * * * *